United States Patent [19]

van Nederveen

[11] 4,276,788

[45] Jul. 7, 1981

[54] PROCESS FOR THE MANUFACTURE OF A DRILL HEAD PROVIDED WITH HARD, WEAR-RESISTANT ELEMENTS

[75] Inventor: Hans B. van Nederveen, Zeist, Netherlands

[73] Assignee: SKF Industrial Trading & Development Co. B.V., Nieuwegein, Netherlands

[21] Appl. No.: 887,931

[22] Filed: Mar. 17, 1978

[30] Foreign Application Priority Data

Mar. 25, 1977 [NL] Netherlands ..... 7703234

[51] Int. Cl.[3] ..... B21K 5/02

[52] U.S. Cl. ..... 76/108 A

[58] Field of Search ..... 175/410, 374, 329, 330; 76/101 R, 101 E, 108 R, 108 A

[56] References Cited

U.S. PATENT DOCUMENTS

| | | | |
|---|---|---|---|
| T970,002 | 9/1977 | Kidder et al. | 175/374 |
| 1,045,954 | 12/1912 | Decker | 175/410 X |
| 2,152,738 | 4/1939 | Jeffery | 76/108 R |
| 2,299,207 | 10/1942 | Bevillard | 76/108 R |
| 2,578,351 | 12/1951 | Griffiths | 76/108 R |
| 2,582,231 | 1/1952 | Catallo | 175/329 X |
| 2,743,495 | 5/1956 | Eklund | 76/108 R X |
| 3,563,325 | 2/1971 | Miller | 175/410 |
| 3,885,637 | 5/1975 | Veprintsev et al. | 175/329 |
| 3,997,011 | 12/1976 | Staroba | 175/410 |

FOREIGN PATENT DOCUMENTS

| | | | |
|---|---|---|---|
| 269103 | 3/1969 | U.S.S.R. | 175/410 |
| 468994 | 7/1975 | U.S.S.R. | 175/410 |

*Primary Examiner*—Othell M. Simpson
*Assistant Examiner*—Roscoe V. Parker
*Attorney, Agent, or Firm*—Daniel M. Rosen; J. David Dainow

[57] ABSTRACT

The method of manufacturing such drill head by embedding the shank portions of hard, wear-resistant cutting elements in a mold containing metal powder, cold isostatically compacting the powder and shank portions to form the core part of the drill head, and hot isostatically compressing this core part to completely densify same.

4 Claims, 5 Drawing Figures

PROCESS FOR THE MANUFACTURE OF A DRILL HEAD PROVIDED WITH HARD, WEAR-RESISTANT ELEMENTS

BACKGROUND OF THE INVENTION

The invention relates to a process for the manufacture of a drill head comprising a core body with hard, wear-resistant cutting elements or cutters fitted therein and projecting from the surface and consisting in essence of a (cutting) tip and a shank or shaft.

Such drill heads are known in the prior art, for example, U.S. Pat. No. 2,687,875 and from practical use. Fastened to drilling tools such drill heads are suitable for forming apertures in hard materials or holes and cavities in the earth. For this purpose a drill head is manufactured from a hard steel body in which very precise apertures must be machined; into such an aperture the shank or shaft portion of a cutting element may be inserted with a press fit. This known process of manufacture has hitherto had a restrictive effect on the shape of the shank portion of the cutting element, which has had a cylindrical or similar form. Apart from the expensive machining of the hard core body which is necessary; there is also a practical disadvantage; because of the relatively large external forces acting on these wear-resistant elements, they are prematurely loosened from their cylindrical or tubular mountings so that drilling is impeded or even becomes impossible.

SUMMARY OF THE INVENTION

The invention introduces a process whereby it is now possible to produce a drill head with the elimination of the above-mentioned restrictions in the shape of the shank or shaft and the associated disadvantage of premature loosening of the cutting elements from the core body. To this end, according to the invention, a compressible mold or template, for example a rubber casting mold, is filled with metal powder, at least the shank or shaft portion of the wear-resistant elements or cutters being embedded in the metal powder, the cutting tips of the cutters are exposed, and the whole combination is then isostatically compacted.

By means of this process hard, wear-resistant elements or cutters may be used in which the shank or shaft is fixed in the core body, that is, the mounting for such elements, may now be given any desired shape, and may, for example, be divergent or tapering, and may be provided with grooves or projections. Consequently a nonseparable bond between the elements or cutters and the isostatically compacted core body is obtained. The invention moreover provides a drill head which is relatively simple to produce and thus less expensive, and which has shape and properties that may be precisely determined.

The invention will now be more particularly described with reference to some exemplary embodiments, with emphasis on the advantages and other features of the invention.

DETAILED DESCRIPTION OF THE PREFERRED EMBODIMENTS

Figure 1:
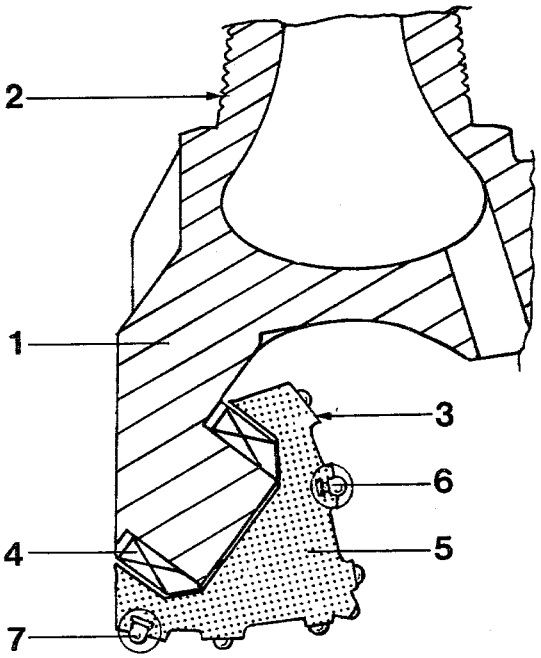
FIG. 1 shows partly in section a portion of a rotatable drill head according to this invention, suitable for drilling the earth's crust.

In the sectional view of FIG. 1 a conical drill element 3 is located on support 1 of a rotatable drill head 2 via bearing 4. The drill element 3 is made from metal powder 5 in accordance with the invention, the hard wear-resistant elements 6, 7 or 8 which project from the surface being fastened in at the same time as it is produced.

Figure 2:
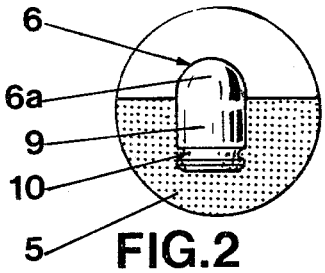
FIGS. 2 and 3 show side elevations, in enlarged scale, of embodiments of the hard, wear-resistant elements each with a rounded drill tip such as may be used in a drill head of the invention.
Figure 3:
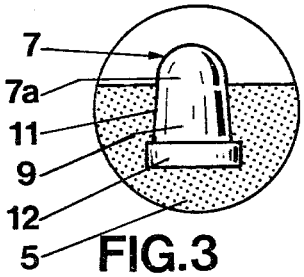

Manufacture is preferably effected by setting the tips *6a* or *7a* (see FIGS. 2 and 3) in part of a rubber mold (not shown) and then filling the whole mold with metal powder 5 before the combination consisting of the rubber mold or template containing the metal powder 5 and the elements 6 or 7 is compacted. Accordingly, one can effect the exact positioning of the hard, wear-resistant elements in the drill element or core body 3 which is to be produced before and during isostatic compacting. After compacting (in the first instance cold compacting) the rubber mold is removed, and in selected cases the "solid" conical drill element 3 is provided with the rear-resistant elements as seen in the embodiments of FIGS. 2 and 3.

By means of the special design of the shank portion of the wear-resistant elements 6, 7, or 8 (see FIGS. 2, 3 and 4) in which, according to the invention, resistance-increasing means such as grooves 10 extending transversely of the longitudinal central axis from said shank portion to said cutting tip, or divergent shapes of stem 11 or projections 12 are used, an insoluble or non-separable bond between these elements 6, 7 or 8 and the compacted drill element or core body 3 is now achieved. To obtain complete densification of drill element 3 hot isostatic compacting is often necessary so that mechanical properties equal to those of steel are achieved, with, however, the important differences; (a) a better bond is obtained, that is, an insoluble or nonseparable bond between the hard, wear-resistant elements 6, 7 or 8 and the core body 3; (b) also the prior disadvantages is eliminated, that is, the prior necessity of the accurate machining of the fixing apertures for the shank or shaft 9 of the wear-resistant elements in the core body. It should be noted that according to FIG. 3 the element 7 at the base of the tapered shank or shaft has a foot 12 partly projecting from it which makes the nonseparable bond between element 7 and core body 3 still more complete.

Figure 4:
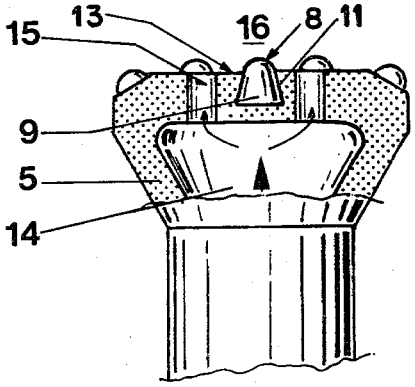
FIG. 4 shows a side elevation of a portion of another embodiment of a rotatable drill head for rock-drilling which is air-driven.

FIG. 4 shows a cross-section of a drill head 13 which is driven by compressed air, see arrow 14, the air being able to escape via eccentrically located apertures 15 in the face 16 of the drill. The hard wear-resistant elements 8, the shank or shaft 9 of which is divergent of tapering, are located on this face 16 of drill head 13.

Figure 5:
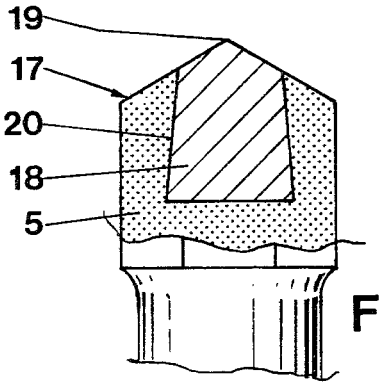
FIG. 5 shows a side elevation of a portion of another embodiment of a rotatable drill head provided with a cutter.

FIG. 5 shows another embodiment of a portion 17 of a drill head according to the invention which is likewise made by cold and/or hot isostatic compacting from metal powder 5, but in which a hard, wear-resistant cutter 18 is located which is provided with a relatively sharp cutting edge 19. In this embodiment the cutter 18 is provided with surfaces 20 which similarly diverge from cutting edge 19; by this arrangement the resistance to loosening of the cutter from its mounting under the influence of external forces is increased, and in fact, is almost impossible. The invention is not, however, restricted to the exemplary embodiments hereinbefore illustrated, since the inventive concepts and practical embodiments herein offer the solution to other problems in the field of the fastening of metallurgically distinct components which are, however, exposed to the same external wear conditions. Nevertheless the main objective has been satisfied, namely the provision of a relatively simple and thus less expensive process for making a drill head.

I claim:

1. In a process for manufacturing a drill head having a core part with hard wear-resistant cutting elements each cutting element comprising a shank part embedded in said core part and a cutting tip at one end of the shank part that projects outward from the surface of said core part, the process comprising the steps:

(a) filling with a metal powder a compressible mold which generally defines said core part, (b) forming the shank of each said cutting elements so that its diameter at at least one point along its length is greater than its diameter at some other point along its length, (c) embedding the shank part of each of said cutting elements in said powder, (d) locating said shank parts of said cutting elements in said powder in the mold in essentially exactly the final position they will have after said step of compacting, (e) cold isostatically compacting said mold and included powder and embedded shank parts thereby precisely forming said drill head are precisely locating said cutting elements therein, and (f) removing said drill head from said mold, and subsequently hot isostatically compacting said drill head until said powder is completely densified.

2. In a process for manufacturing a drill head having a core and hard, wear-resistant cutting elements, each cutting element comprising a shank with a base part at one end and a cutting tip at the opposite end, said base part and at least a portion of said shank being embedded in said core and hereinafter designated embedded section, with said cutting tip projecting outward beyond the surface of said core, the process comprising the steps:

a filling with a metal powder a compressible mold which generally defines said core, b forming said base part of a typical cutting element to have a diameter greater than the diameter of the shank, c embedding said embedded sections of said cutting elements in said powder, d locating said embedded sections of said cutting elements in said powder in the mold is essentially exactly the final positions they will have after said step of compacting, e cold isostatically compacting said mold and included powder and embedded sections, thereby precisely forming said drill head and precisely locating said cutting elements therein, and f removing said drill head from said mold, and subsequently hot isostatically compacting said drill head until said powder is completely densified.

3. In a process for manufacturing a drill head having a core and hard, wear-resistant cutting elements, each cutting element comprising a shank with a base part at one end and a cutting tip at the opposite end, said base part and at least a portion of said shank being embedded in said core and hereinafter designated embedded section, with said cutting tip projecting outward beyond the surface of said core, the process comprising the steps:

a filling with a metal powder a compressible mold which generally defines said core, b forming the shank part of each of said cutting elements to have a tapered shape that diverges in the direction from said cutting tip toward said shank part, c embedding said embedded sections of said cutting elements in said powder, d locating said embedded sections of said cutting elements in said powder in the mold in essentially exactly the final positions they will have after said step of compacting, e cold isostatically compacting said mold and included powder and embedded sections, thereby precisely forming said drill head and precisely locating said cutting elements therein, and f removing said drill head from said mold, and subsequently hot isostatically compacting said drill head until said powder is completely densified.

4. In a process for manufacturing a drill head having a core and hard, wear-resistant cutting elements, each cutting element having a central longitudinal axis and comprising a shank with a base part at one end and a cutting tip at the opposite end, said base part and at least a portion of said shank being embedded in said core and hereinafter designated embedded section, with said cutting tip projecting outward beyond the surface of said core, the process comprising the steps:

a filling with a metal powder a compressible mold which generally defines said core, b providing projections that extend from said shank part transversely of said axis, c embedding said embedded sections of said cutting elements in said powder, d locating said embedded sections of said cutting elements in said powder in the mold in essentially exactly the final positions they will have after said step of compacting, e cold isostatically compacting said mold and included powder and embedded sections, thereby precisely forming said drill head and precisely locating said cutting elements therein, and f removing said drill head from said mold, and subsequently hot isostatically compacting said drill head until said powder is completely densified.

* * * * *

UNITED STATES PATENT AND TRADEMARK OFFICE

CERTIFICATE OF CORRECTION

PATENT NO. : 4,276,788

DATED : July 7, 1981

INVENTOR(S) : Hans B. van Nederveen

It is certified that error appears in the above—identified patent and that said Letters Patent is hereby corrected as shown below:

Column 2, line 30, change "rear" to --wear--.

Column 3, line 57, change "is" to --in--.

Signed and Sealed this

*Sixteenth* Day of *February 1982*

[SEAL]

*Attest:*

GERALD J. MOSSINGHOFF

*Attesting Officer*

*Commissioner of Patents and Trademarks*